US006300906B1

(12) United States Patent
Rawnick et al.

(10) Patent No.: US 6,300,906 B1
(45) Date of Patent: Oct. 9, 2001

(54) WIDEBAND PHASED ARRAY ANTENNA EMPLOYING INCREASED PACKAGING DENSITY LAMINATE STRUCTURE CONTAINING FEED NETWORK, BALUN AND POWER DIVIDER CIRCUITRY

(75) Inventors: James J. Rawnick, Palm Bay, FL (US); Warren L. Stutzman; J. Randall Nealy, both of Blacksburg, VA (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/477,853

(22) Filed: Jan. 5, 2000

(51) Int. Cl.[7] ..... H01Q 1/38; H01Q 21/00
(52) U.S. Cl. ..... 343/700 MS; 343/853
(58) Field of Search ..... 343/700, 853

(56) References Cited

U.S. PATENT DOCUMENTS

| | | | | |
|---|---|---|---|---|
| 3,681,769 | | 8/1972 | Perrotti et al. | 343/814 |
| 4,825,220 | | 4/1989 | Edward et al. | 343/795 |
| 4,973,972 | | 11/1990 | Huang | 343/700 MS |
| 5,036,335 | | 7/1991 | Jairam | 343/767 |
| 5,572,172 | | 11/1996 | Standke et al. | 333/128 |
| 5,896,107 | * | 4/1999 | Huynh | 343/700 MS |
| 5,926,137 | | 7/1999 | Nealy | 343/700 MS |

OTHER PUBLICATIONS

Article From Ph.D. Thesis Entitled: Analysis Of Infinite Arrays Of Arbitrarily Shaped Planar Radiating Elements Usining A Floquet Mode Based Method Of Moments Approach, by James William LaPean, Jr. et al, Virginia Polytechnic Institute and State University, 1996, pp. 114–116.

* cited by examiner

*Primary Examiner*—Michael C. Wimer
(74) *Attorney, Agent, or Firm*—Allen, Dyer, Doppelt, Milbrath & Gilchrist, P.A.

(57) ABSTRACT

A 'four-square element' phased array antenna structure and associated feed network laminate architecture has a linear physical geometry of multiple trimmed four-square antenna elements disposed on a thin dielectric support layer, which facilitates compactly placing multiple linear arrays in a highly spatially densified side-by-side arrangement. This allows for placement of a greater number of antenna elements in a direction orthogonal to the array than in the longitudinal dimension of the array, so that the frequency of operation of an overall array can be increased relative to that of a conventional four-square architecture, thereby improving bandwidth coverage. For a linearly polarized beam, the trimmed four-square array of the invention enjoys a frequency response that is equal to or better than that of a conventional non-trimmed four-square architecture.

9 Claims, 8 Drawing Sheets

WIDEBAND PHASED ARRAY ANTENNA EMPLOYING INCREASED PACKAGING DENSITY LAMINATE STRUCTURE CONTAINING FEED NETWORK, BALUN AND POWER DIVIDER CIRCUITRY

FIELD OF THE INVENTION

The present invention relates in general to communication systems, and is particularly directed to a new and improved, highly compact, phased array antenna architecture having a plurality of antenna elements, that are integrated in a compact and highly densified laminate structure with, and fed by, associated signal distribution networks of a printed circuit power divider network that incorporates a balun feeding each pair of power dividers.

BACKGROUND OF THE INVENTION

Among desired characteristics of multielement antenna systems (e.g., phased array antennas) of the type that may be folded, stowed and deployed from a mobile platform, such as a satellite launch vehicle, are that the antennas be physically compact (low profile) and lightweight, while also being sufficiently broadband to meet performance requirements of terrestrial communication systems. Although progress has been made in reducing the physical size and packaging density of the radiating elements, per se, the substantial physical space required to implement and mount their associated feed networks and interconnection circuitry have effectively limited the size and packaging density of the total system.

SUMMARY OF THE INVENTION

Pursuant to the present invention, there is provided a new and improved, highly compact, wideband multi-element antenna structure that successfully integrates within a relatively thin laminate structure a plurality of closely spaced and fed printed circuit antenna elements, together with their associated feed, balum and power divider networks, in a support architecture that enjoys a significantly reduced size and packaging density compared with prior art systems.

In accordance with a non-limiting example of a multi-element two dimensional antenna array, each of its radiating elements may be configured as a 'trimmed' four-square arrangement, selectively etched or plated atop a thin dielectric support layer. By 'trimmed' four-square is meant that outer edges of two diametrically opposed, non-fed components of a set of four, closely spatially arrayed square-shaped components have a 'shaped' or 'trimmed' square geometrical configuration. This outer edge trimming of the two non-fed components allows multiple four-squares to be arranged side-by-side in a relatively tightly packed array, thereby providing a substantially enhanced spatial density.

In order to conform with the narrow geometry of an individual linear array of such 'trimmed' four-square antenna elements, the support structure for the associated feed, balum and power divider circuitry is configured of a laminate design. This laminate design contains a plurality of power divider-feed networks that incorporate printed circuit baluns for alternate sets of antenna elements linearly distributed on a stripe-shaped dielectric feed network support member, that forms part of a multilayer architecture containing the antenna array. The feed network support member is spaced apart from subarrays of the antenna elements by a layer of dielectric, such as lightweight foam.

A stripline ground plane metalization layer is formed on the bottom surface of the feed network support layer. A printed circuit power divider network includes a balun and an associated printed circuit branch network for feed ports of the driven antenna elements. The balun is coupled through a plated aperture in the dielectric support layer to the center conductor of a subarray feed port at the bottom surface of the support layer and is dielectrically isolated from the ground plane metalization layer on the bottom surface of the dielectric support layer.

DETAILED DESCRIPTION

Figure 1:
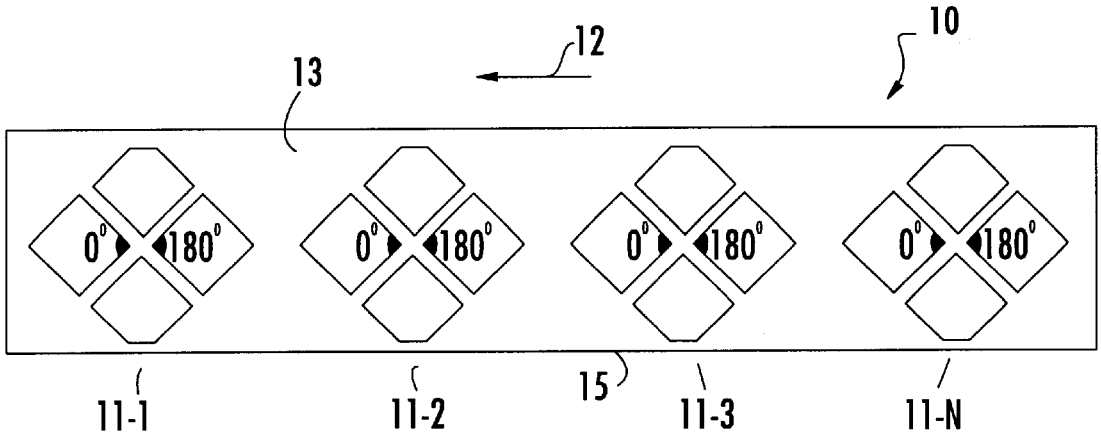
FIG. 1 is a diagrammatic plan view of a linear array of 'trimmed' four-square antenna elements.

Referring now to FIGS. 1–14 of the drawings, a first non-limiting example of the application of the compact laminate antenna architecture of the invention to a four-square wideband phased array antenna array will be described. The invention will be initially described for the case of a 'trimmed' four-square array, shown in FIG. 1 as a linear subarray 10 of printed metalization trimmed four-square elements 11-1, 11-2, . . . , 11-N. Each four-square element 11 (shown in greater detail in FIG. 2, to be described) may comprise one ounce copper metalization patches), that are selectively plated or etched in a linear array on the top surface 13 of a thin, low loss dielectric support layer 15, such as sheet of 28 mils thick Duroid 5870. As diagrammatically illustrated in FIG. 3, in a multi-element laminate structure, the support layer 15 is mounted to a first surface 16 of a relatively lightweight spacing layer 17, such as a layer of plastic foam material (such as Rohacell 51HF foam), having a ground plane layer 18 formed on opposite surface 19 of foam spacing layer 17.

When used with the power distribution feed laminate structure of the invention, the thickness of lightweight foam spacing layer 17 is such that, when combined with the thicknesses of the dielectric support layer 15 and those of the laminate structure, the total separation or spacing between the four-square antenna patch metalizations 11 and a ground plane metalization layer on the bottom surface of the laminate is preferably on the order of one-quarter of the wavelength of the highest frequency of operation of the array.

Figure 2:
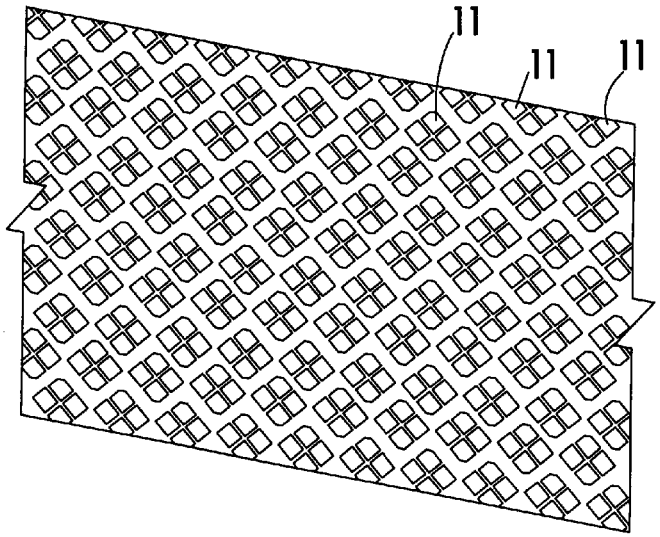
FIG. 2 is a diagrammatic plan view of an individual trimmed four-square antenna element.

As shown in the enlarged plan view of FIG. 2, each 'trimmed' four-square element 11-*i* of the linear subarray 10 of FIG. 1 is configured as four, generally square-shaped conductive (metal) components or layers 21, 22, 23 and 24, that are placed closely adjacent to one another on the top surface 13 of dielectric support layer 15 in a generally square configuration, and are mutually spaced apart by narrow gaps 31, 32, 33 and 34 therebetween. The overall diagonal length D of an individual four-square element 11-*i* along longitudinal dimension 12 of linear subarray 10 may be on the order of one-half wavelength at the lowest frequency of operation of an antenna element.

Each of the component-to-component gaps 31–34 may have a width W on the order of ten mils, leaving an interior diagonal corner-to-corner spacing SD on the order of 14.14 mils, as non-limiting example. The input impedance of a respective trimmed four-square antenna element 11-*i* is determined partially by the gap width, partially by the dimensions of its four-square components 21–24, and by the height or separation of the element above the underlying ground plane 18.

Within a respective trimmed four-square antenna element 11-*i*, two diametrically opposed components 21 and 23 are electrically driven by means of a balanced power divider feed network to be described, at feed points 21F and 23F immediately their adjacent interior corners 41 and 43. This allows the trimmed four-square antenna element to be effectively fed at a center region thereof, so as to produce, for example, a broadside scanned linearly polarized radiation pattern. The physical separation or distance F between feed points 21F and 23F should be as small as possible, and is ideally equal to the diagonal gap separation between the diagonally opposed interior corners 41 and 43 of the respective driven components 21 and 23.

Figure 3:
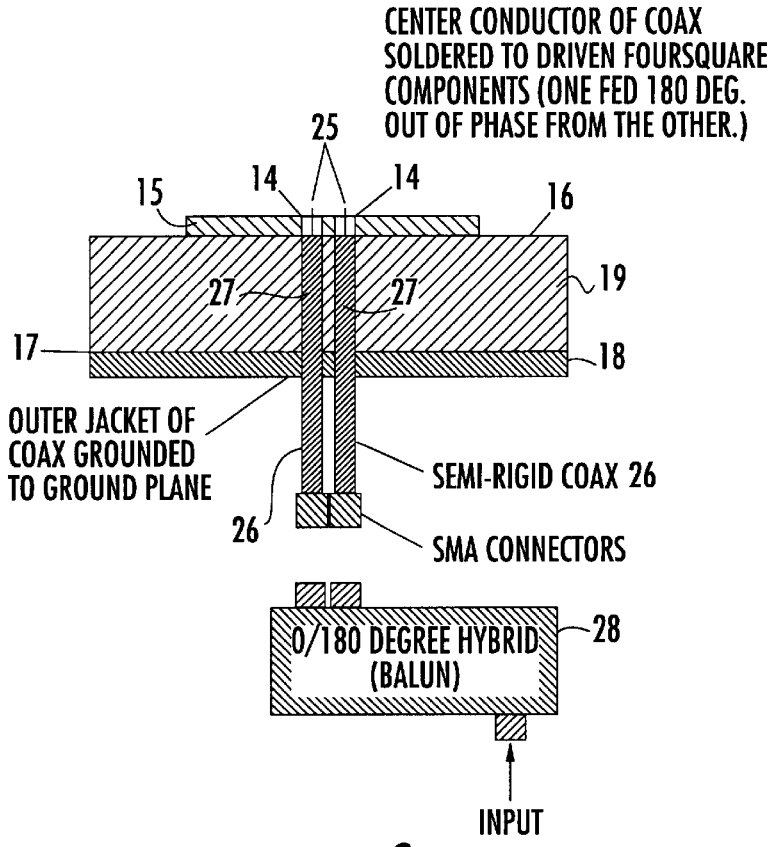
FIG. 3 is a diagrammatic side view of an individual trimmed four-square antenna element.

The feed points 21F and 23F may be slightly displaced from the corners of driven components 21 and 23, so as to provide sufficient surrounding metal for the attachment of center conductors 25 of sections of the coaxial cable 26 extending through plated apertures 14 in the support layer 15 and apertures 27 in the foam spacing layer 17, as shown diagrammatically in the side sectional view of FIG. 3. As a non-limiting example, the separation distance F between feed points 21F and 23F may be on the order of 86 mils. By appropriate opposite phase ((0°/180°) feeding of the two opposed driven components 21 and 23 of a respective four-square element 11-*i*, such as porting the coax cable sections 26 to 0° and 180° ports of a balun 28, linear polarization can be produced, thereby enabling the overall array to produce a highly directive linear polarization scanning of the beam, by controlling the phase for the driven components in a conventional manner.

As further shown in the enlarged plan view of FIG. 2, the non-driven (or parasitic) and diametrically opposed 'trimmed' components 22 and 24 of a respective trimmed four-square trimmed antenna element 11-*i* are located between the (0°/180°) driven components 21 and 23. As noted previously, by 'trimmed' is meant that outer corner portions of the non-fed components 22 and 24 of the set of four, shown in broken lines 52 and 54, respectively, are effectively shaped as though they have been 'trimmed' away.

Namely, outer edges 62, 64 of the two diametrically opposed, non-fed components 22 and 24 are parallel to each other, and form acute angles with lines parallel to side edges of the square-shaped opposite phase-driven components 21 and 23. This trimmed shape leaves the side edges of a respective four-square element parallel to the longitudinal dimension 12 of the subarray 10. A typical trim spacing or margin T between side edges 62, 64 and parallel side edges 16, 17 of the low loss dielectric support layer 15 may be on the order of ten mils, as a non-limiting example.

Figure 4:
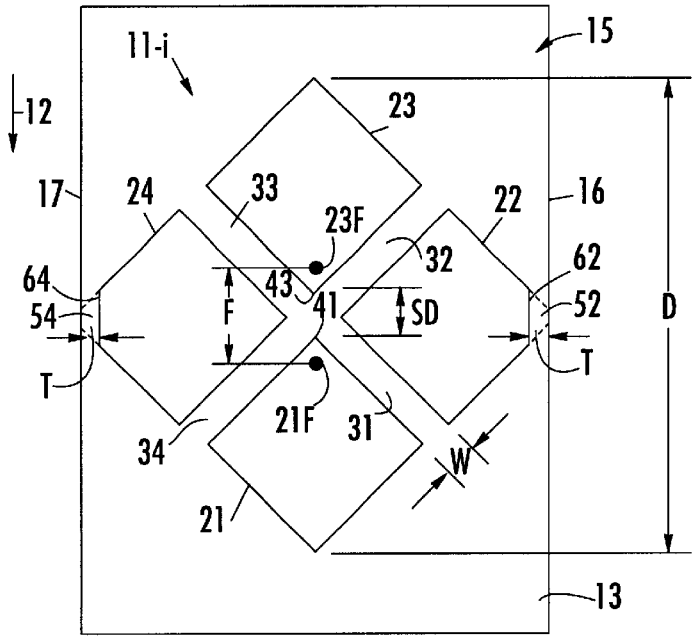
FIG. 4 shows a two-dimensional compact antenna array having a plurality of trimmed four-square antenna elements.

As pointed out above, such trimmed corner-shaping of the side edges 62 and 64 of the non-driven components 22 and 24 provides what is effectively a linear physical geometry of multiple trimmed four-square antenna elements 11 atop the narrow, thin dielectric support layer 15, and thereby facilitates compactly placing multiple trimmed subarrays in a highly spatially densified side-by-side arrangement, such as that shown in FIG. 4. This allows for placement of more trimmed-square antenna elements 11 in a direction orthogonal to a subarray array 10 than in the longitudinal dimension of a subarray, so that the frequency of operation of an overall array comprised of the trimmed four-square antenna elements of the invention can be increased relative to that of a conventional four-square architecture, thereby improving bandwidth coverage. For a linearly polarized beam, a trimmed four-square array enjoys a frequency response that is equal to or better than a conventional non-trimmed four-square architecture.

Figure 9:
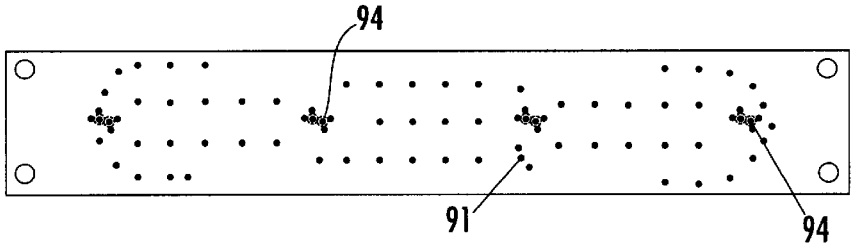
FIG. 9 shows a distribution of input ports of the printed circuit power divider laminate structure of the antenna architecture of FIG. 5.
Figure 10:
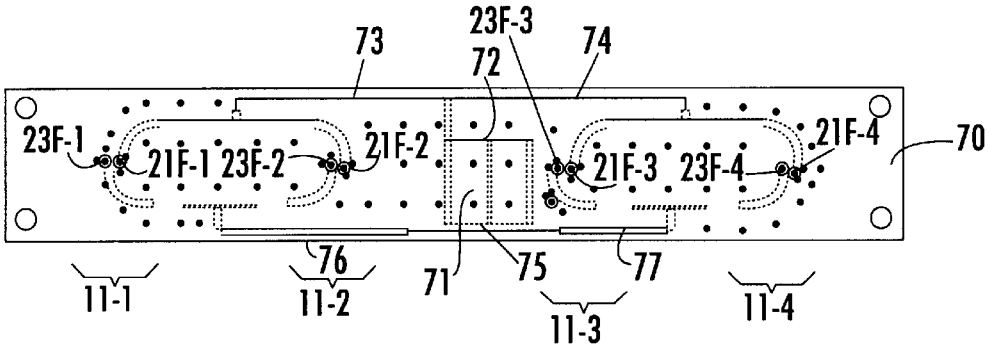
FIG. 10 shows the printed circuit configuration of the power divider-feed network of the laminate structure of the antenna architecture of FIG. 5.
Figure 11:
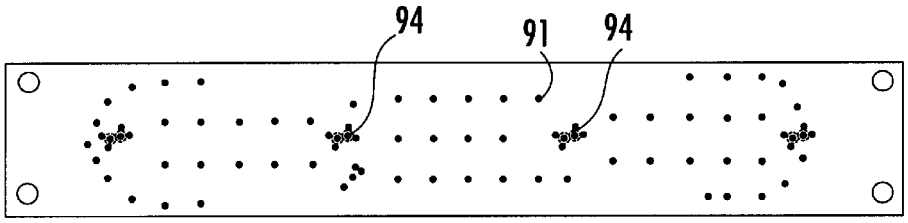
FIG. 11 shows a distribution of output ports of the printed circuit power divider laminate structure of the antenna architecture of FIG. 5.

As shown in the side views of FIGS. 5–8 and the plan views of FIGS. 9–11, in order to conform with the desired 'narrowness' of the trimmed or linear geometry of an individual stripe shaped subarray 10 shown in FIG. 1, the compact packaging architecture of the invention distributes a stripline-configured power divider-feed network 70 within a laminate structure 80, interposed between the bottom surf ace 19 of the foam support layer 17 and the ground plane layer 18. The printed circuit power divider network 70 is configured for the set of four, spatially successive, trimmed four-square antenna elements 11-1, 11-2, 11-3, 11-4 formed atop the support layer 15.

In particular, power divider-feed network 70, having the printed circuit configuration shown in detail in the plan view of FIG. 10, is formed on the bottom surface 81 of a first, generally stripe-shaped dielectric feed network support layer 82. Like the dielectric support layer 15, the dielectric support layer 82 may comprise a 28 mil thick layer of Duroid 5870. A top surface 83 of the support layer 82 has a distribution of input ports 91, shown in FIG. 9, that are connected by conductive vias 84 through support layer 82 to various connection points of the printed circuit network 70, as shown in the side view FIG. 6.

An input port 91 provides an attachment location for the center conductor 25 of a section of coax cable 26, which terminates at or abuts against the bottom surface 85 of a second generally stripe-shaped dielectric support layer 86 of the laminate structure 80. Dielectric support layer 86 may also comprise a 28 mil thick layer of Duroid 5870. A solder connection of the terminal end of the center conductor 25 of coax cable 26 to plated through hole 84 may be effected by using a metallic toroid or 'donut' 89.

Figure 5:
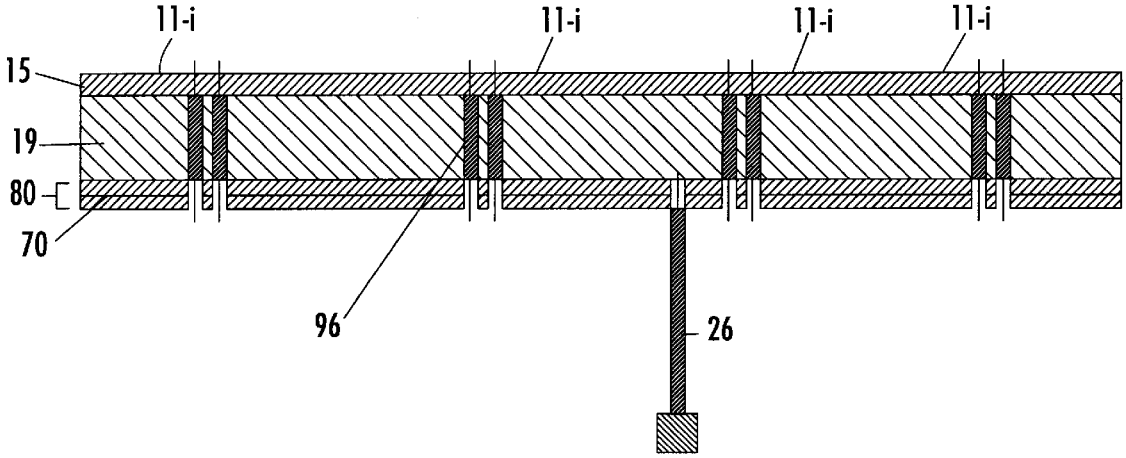
FIG. 5 is a diagrammatic side view of a laminate antenna architecture in accordance with the present invention containing a plurality of (four) linearly arranged, trimmed four-square antenna elements fed by an associated printed circuit power divider feed network.
Figure 6:
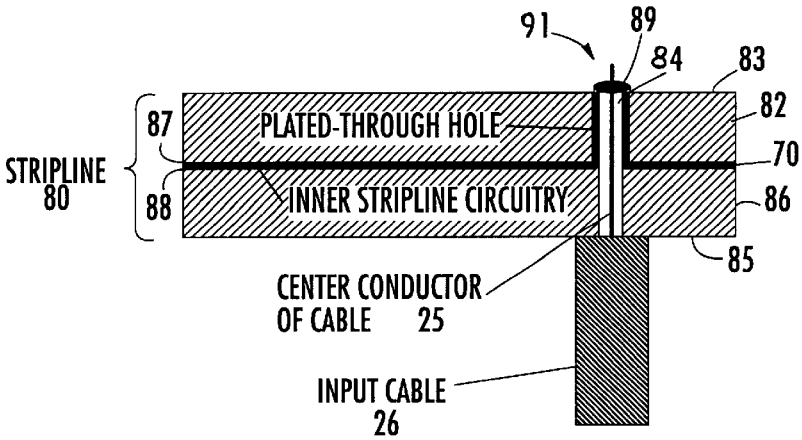
FIG. 6 is a diagrammatic side view of the connection of an input coax cable to the printed circuit power divider laminate structure of the antenna architecture of FIG. 5.
Figure 7:
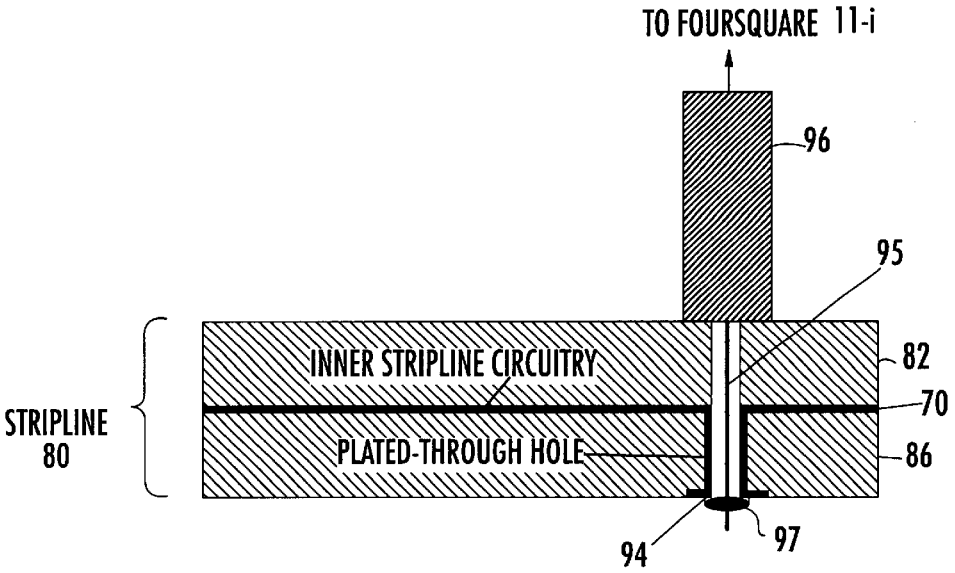
FIG. 7 is a diagrammatic side view of the connection of an output coax cable from the printed circuit power divider laminate structure of the antenna architecture of FIG. 5.
Figure 8:
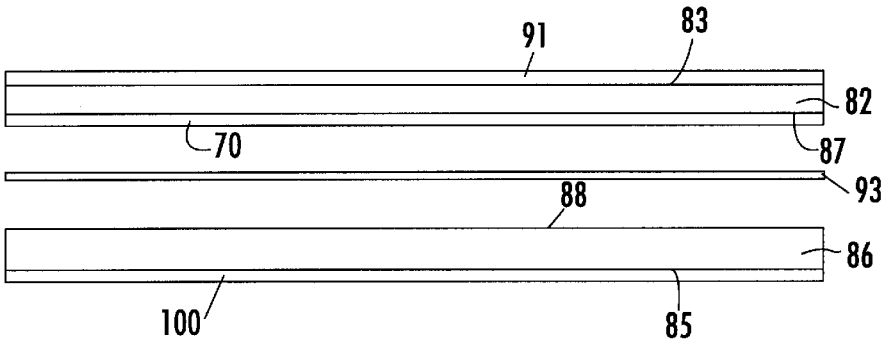
FIG. 8 is a diagrammatic side view of components of the printed circuit power divider laminate structure of the antenna architecture of FIG. 5.

As shown in FIG. 5, using a bonding layer (film) 93, the bottom surface 87 of the support layer 82 and the power divider-feed network 70 are laminated against top surface 88 of the second, generally stripe-shaped dielectric support layer 86. A stripline ground plane metalization layer 100, such as one ounce copper, is ubiquitously formed on bottom surface 85 of support layer 86. As shown in the side view of FIG. 7, that is essentially complementary to the configuration of FIG. 6, the bottom surface 85 of the support layer 86 contains a distribution of output ports 93, distributed as shown in the plan view of FIG. 11.

The output ports are connected by way of conductive vias 94 through the support layer 85 to various connection points of the printed circuit network 70. An output port 93 provides an attachment location for the center conductor 95 of a section of input coax cable 96, which terminates at or abuts against the top surface 85 of the first generally stripe-shaped dielectric support layer 82 of the laminate structure 80. Again, a solder connection of the terminal end of the center conductor 95 of coax cable 96 to plated through hole 94 may be readily effected by using a metallic toroid or 'donut' 97. The input coax cable sections 96 may be ported to external drive circuitry by way of an SMA type connector, as a non-limiting example.

As shown in FIG. 10, pursuant to the laminate-based architecture of the invention, the printed circuit power divider network 70 is configured to include a balun 71 and an associated printed circuit branch network for the (0°/180°) feed ports of the fed components of the trimmed four-square elements of the subarray 10. A first branch 72 of balun 71 extends via a first printed circuit link 73 to a first pair of spaced apart, trimmed four-square subarray feed ports 21F-1, 23F-2 for the first driven components 21 of respective first and second trimmed four-square antenna elements 11-1, 11-2 atop support layer 15.

In a similar fashion, a second printed circuit link 74 extends from the balun 71 to a second pair of spaced apart feed ports for 21F-3, 21F-4 of driven components 21 of respective third and fourth second trimmed four-square elements 11-3, 11-4. Also, extending from a second branch 75 of balun 71 is a third printed circuit link 76 to a third pair of spaced apart, the trimmed component feed ports 23F-1, 23F-2 for the driven components 23 of the first and second trimmed four-square elements 11-1, 11-2. A fourth printed circuit link 77 extends from the balun to a fourth pair of spaced apart feed ports 23F-3, 23F-4 for the driven components 23 of the third and fourth trimmed four-square elements 11-3, 11-4.

Figure 12:
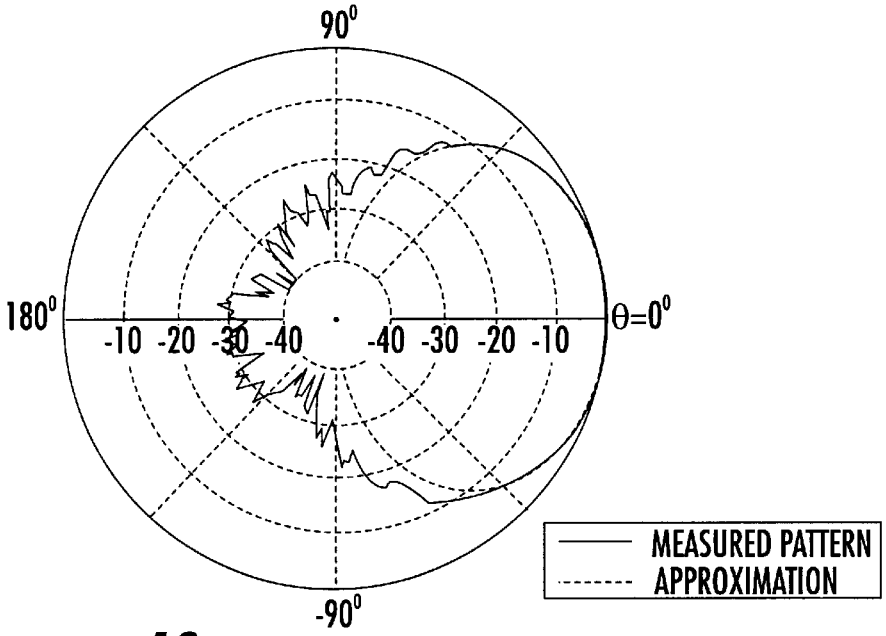
FIGS. 12 and 13 are respective E- and H-plane co-polarized antenna patterns produced by a trimmed four-square antenna element.
Figure 13:
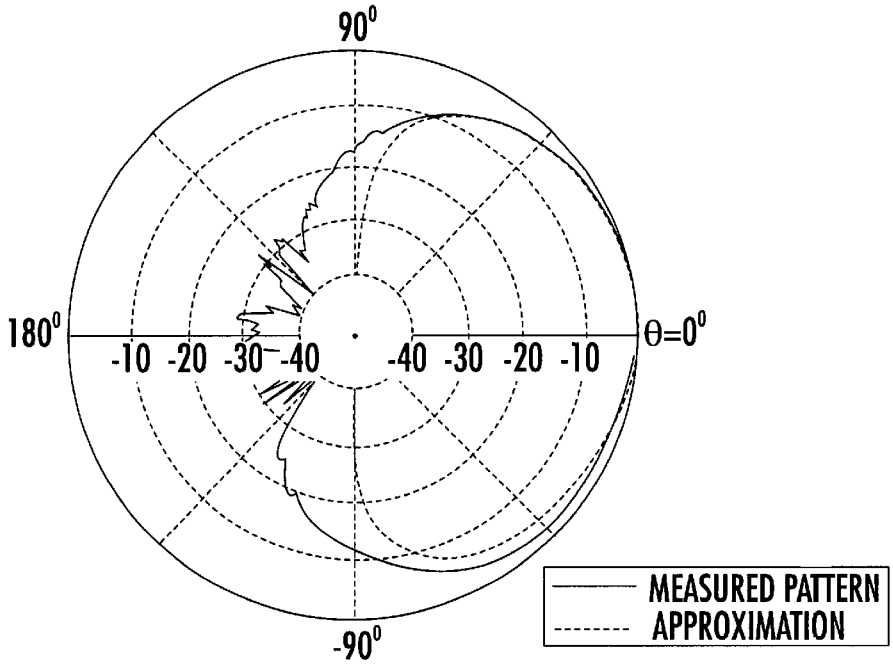
Figure 14:
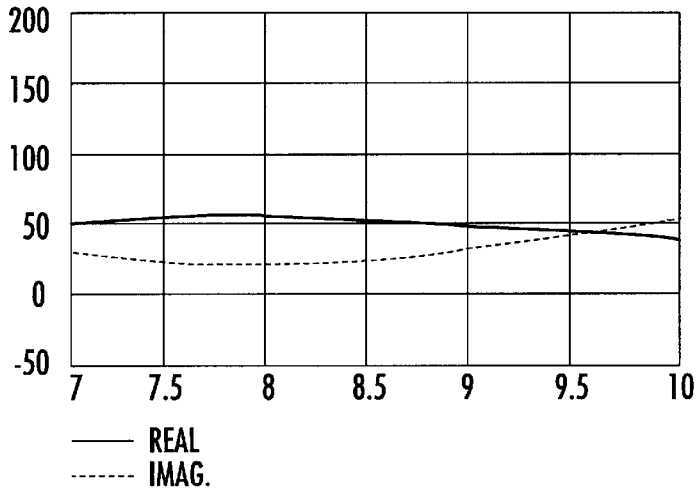
FIG. 14 is a plot of impedance vs frequency of a trimmed four-square antenna element.

FIGS. 12 and 13 depict, in solid lines, respective E- and H-plane co-polarized antenna patterns of a trimmed four-square element in accordance with the invention. Shown in broken lines are associated E- and H- plane patterns approximated using a $\mathrm{Cos}^q(\theta)$ pattern (for 0° less than or equal to θ, and θ less than or equal to 90°. The value for q is equal to the ratio: $\log(F(\theta))/\log(\cos\theta)$, where θ is taken at −10 dB points. The $\cos^q(\theta)$ assumes no backplane radiation. In the co-polarized E-plane radiation pattern of FIG. 12, q=2.37, at a frequency of 8.5 GHz; in the co-polarized H-plane radiation pattern of FIG. 13, q=1.07, at a frequency of 8.5 GHz. FIG. 14, which is a plot of impedance vs frequency of a trimmed four-square antenna element, shows that its impedance characteristics are equal to or better than those of a conventional non-trimmed four-square element.

Figure 15:
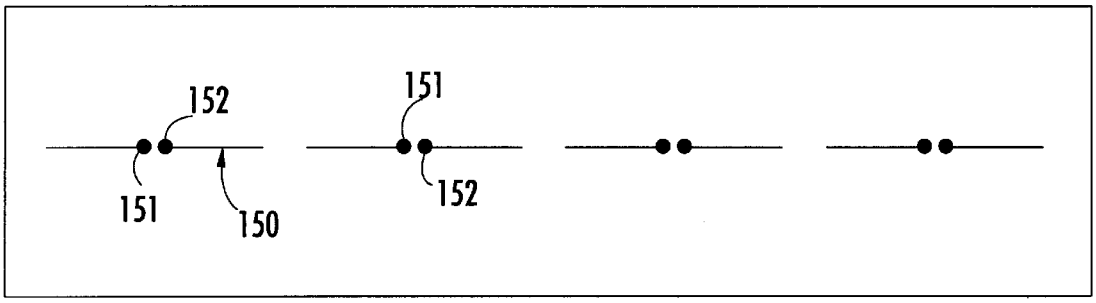
FIG. 15 is a diagrammatic plan view of a linear array of relatively 'narrow' printed dipole antenna elements.

Although the laminate configured phased array antenna architecture of the present invention has been described for the case of a 'trimmed four-square'-based phased array antenna, it should be observed that the invention may be used with other types of radiating elements, whose spatial configurations readily lend themselves to being ported to the laminate-integrated power divider, balun and feed networks therefor. As non-limiting examples, FIG. 15 shows a linear array of relatively 'narrow' printed dipole antenna elements 150, whose feed ports 151, 152 are spatially positioned in effectively the same geometry as the feed ports 23 of the trimmed four-square arrangement of FIGS. 1–14, and may be readily mated with the underlying feed network laminate structure of the trimmed four-square embodiment.

Figure 16:
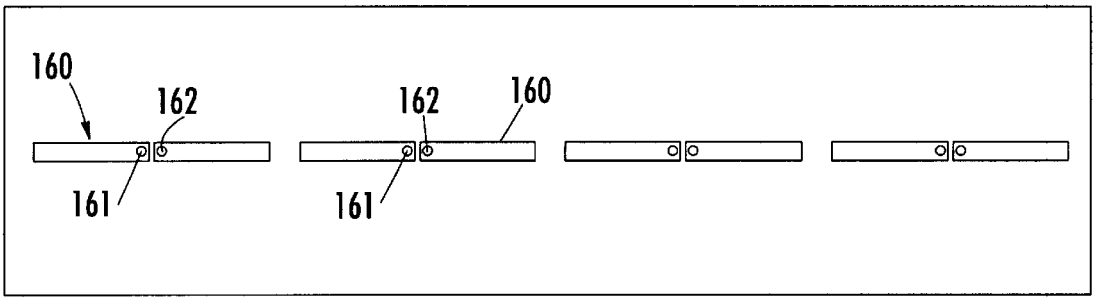
FIG. 16 is a diagrammatic plan view of a linear array of relatively 'wide' printed dipole antenna elements.
Figure 17:
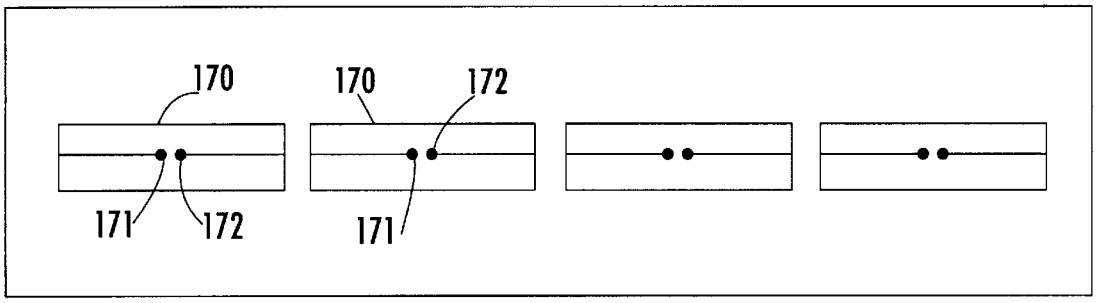
FIG. 17 is a diagrammatic plan view of a linear array of printed folded dipole antenna elements.
Figure 18:
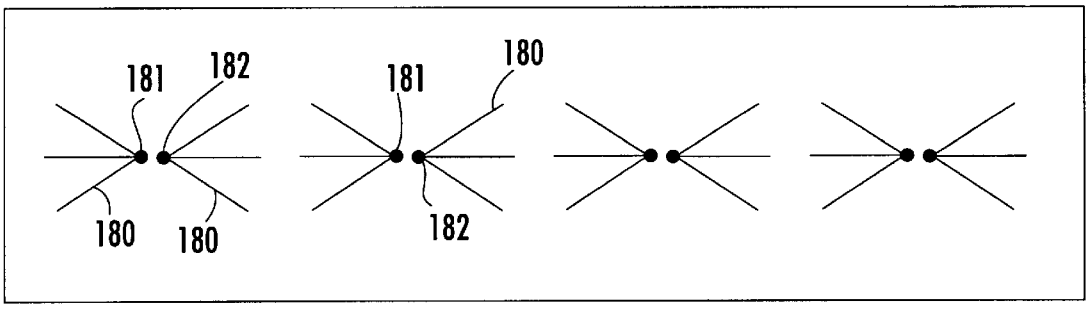
FIG. 18 is a diagrammatic plan view of a linear array of printed fan dipole antenna elements.
Figure 19:
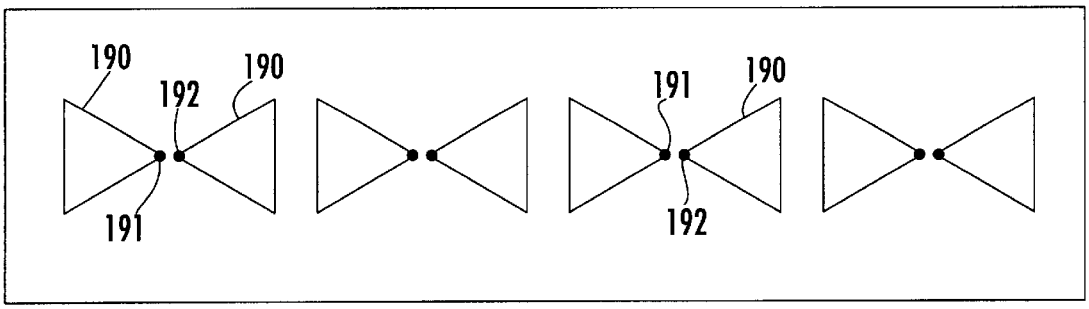
FIG. 19 is a diagrammatic plan view of a linear array of printed bowtie dipole antenna elements.
Figure 20:
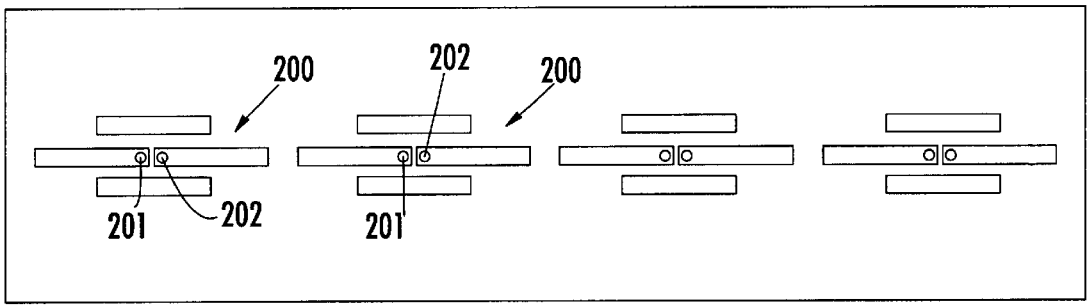
FIG. 20 is a diagrammatic plan view of a linear array of printed open sleeve dipole antenna elements.

In like manner, FIG. 16 shows a linear array of relatively 'wide' printed dipole antenna elements 160 having similarly spatially located feed ports 161, 162. FIG. 17 shows a linear array of printed folded dipole antenna elements 170 having adjacent pairs of feed ports 171, 172, while FIG. 18 shows a linear array of printed fan dipole antenna elements 180 with pairs of feed ports 181, 182. FIG. 19 shows a linear array of printed bowtie dipole antenna elements 190 having closely spaced feed ports 191, 192, and FIG. 20 shows a linear array of printed open sleeve dipole antenna elements 200 with adjacent feed ports 201, 202.

While we have shown and described several embodiments in accordance with the present invention, it is to be understood that the same is not limited thereto but is susceptible to numerous changes and modifications as are known to a person skilled in the art, and we therefore do not wish to be limited to the details shown and described herein, but intend to cover all such changes and modifications as are obvious to one of ordinary skill in the art.

What is claimed is:

1. A phased array antenna and feed network laminate architecture comprising:

a plurality of printed circuit antenna elements, each antenna element being configured as a trimmed four-square configuration of conductive components disposed atop a dielectric support layer, and wherein selected ones of said conductive components have a geometrical configuration different than that of selected others of said conductive components of said four-square configuration; and a plurality of printed circuit power divider-feed networks containing printed circuit baluns and branch networks therefrom, configured to feed driven components of said antenna elements, linearly distributed on a first side of a dielectric feed network support member arranged as part of a multilayer architecture containing said plurality of printed circuit antenna elements, said dielectric feed network support member being spaced apart from said plurality of four-square configured antenna elements by dielectric material therebetween and having a ground plane layer on a second side thereof, wherein selected areas of said conductive components have a square geometrical configuration, and a trimmed square geometrical configuration, with outer edges thereof parallel to each other, and forming acute angles with lines parallel to sides edges of said selected others of said conductive components of said square geometrical configuration.

2. A phased array antenna and feed network laminate architecture according to claim 1, wherein said driven components of said antenna elements are said selected others of said conductive components of said square geometrical configuration.

3. A phased array antenna and feed network laminate architecture according to claim 1, wherein a respective printed circuit antenna element comprises a set of four, generally square-shaped conductive components disposed adjacent to one another in a generally square array, and wherein two diagonally opposed square shaped driven components are coupled to a power divider feed network at feed points immediately adjacent to interior corners thereof, and wherein non-driven diametrically opposed conductive components have side edges thereof trimmed so as to be parallel to a longitudinal dimension of said generally square array.

4. A phased array antenna and feed network laminate architecture according to claim 1, wherein a respective printed circuit power divider network is configured to feed driven conductive components of a set of four, spatially successive, trimmed four-square antenna elements disposed on said dielectric support layer, and includes a balun and an associated printed circuit branch network that feed ports of diametrically opposed driven conductive components of trimmed four-square elements, said balun having a feed point coupled through a conductive transmission line aperture in said dielectric feed network support member.

5. An antenna structure for use in a phased array antenna comprising a laminate arrangement of four-square configured antenna elements disposed on a dielectric support layer, in which selected ones of components of said four-square configured antenna elements have a geometrical configuration different than that of selected others of said four-square configured antenna elements, and a printed circuit power divider-feed network containing a printed circuit balun and a branch network therefrom, configured to feed driven components of said four-square configured antenna elements, distributed on a first side of a dielectric feed network support member, said dielectric feed network support member being spaced apart from said antenna elements by dielectric material therebetween, and having a ground plane layer on a second side thereof, wherein selected ones of said conductive components have a square geometrical configuration, and a trimmed square geometrical configuration, with outer edges thereof parallel to each other, and forming acute angles with lines parallel to side edges of said selected others of said conductive components of said square geometrical configuration.

6. An antenna structure according to claim 5, wherein two diagonally opposed driven components of an antenna element have a square geometrical configuration and are coupled to said power divider feed network at feed points immediately adjacent to interior corners thereof, and wherein two non-driven diametrically opposed components of an antenna element have outer edges that are parallel to each other, and form acute angles with lines parallel to side edges of said driven components of an antenna element of said square geometrical configuration.

7. A method of configuring a phased array antenna architecture comprising the steps of:

(a) forming, on a dielectric support layer, a plurality of printed circuit antenna elements, each of which is configured as a trimmed four-square antenna element arranged as a respective four component configuration of trimmed square geometrically configured components, and having outer edges thereof shaped so as to be parallel to each other an to a longitudinal dimension of said plurality of antenna elements and forming acute angles with lines parallel to side edges of selected others of said conductive components of trimmed square geometrically configured components;

(b) forming a plurality of printed circuit power divider-feed networks containing printed circuit baluns and branch networks therefrom, configured to feed driven components of pluralities of said four-square antenna elements, on a first side of a dielectric feed network support member, and a ground plane layer on a second side thereof; and (c) arranging said dielectric support layer upon which said plurality of printed circuit antenna elements are formed, and said dielectric feed network support member upon which said plurality of printed circuit power divider-feed networks are formed as a multilayer architecture containing said plurality of trimmed four-square antenna elements, with said dielectric feed network support member being spaced apart from and electrically connected to said plurality of printed circuit antenna elements through a spacing layer of dielectric material therebetween.

8. A method according to claim 7, wherein step (a) comprises configuring a respective printed circuit antenna element as a set of four, generally square-shaped components disposed adjacent to one another in a generally square array, in which non-driven diametrically opposed components are shaped to have side edges parallel to said longitudinal dimension of said plurality of antenna elements, and wherein step (c) comprises coupling two diagonally opposed driven components of an antenna element to a power divider feed network at feed points immediately adjacent to interior corners thereof.

9. A method according to claim 8, wherein a respective printed circuit power divider network is configured to feed two diametrically opposed driven components of each of four, spatially successive antenna elements supported on said dielectric layer, and includes a balun and an associated printed circuit branch network that feed ports of said diametrically opposed driven components of four-square antenna elements, said balun having a feed point coupled through a conductive transmission line aperture in said dielectric feed network support member.

* * * * *